US010947730B2

(12) United States Patent
Nowacek

(10) Patent No.: US 10,947,730 B2
(45) Date of Patent: Mar. 16, 2021

(54) ROOFING TRIM SADDLE SYSTEM AND METHOD OF INSTALLING

(71) Applicant: David Carl Nowacek, San Antonio, TX (US)

(72) Inventor: David Carl Nowacek, San Antonio, TX (US)

( * ) Notice: Subject to any disclaimer, the term of this patent is extended or adjusted under 35 U.S.C. 154(b) by 0 days.

(21) Appl. No.: 16/510,905

(22) Filed: Jul. 13, 2019

(65) Prior Publication Data

US 2021/0010268 A1 Jan. 14, 2021

(51) Int. Cl.
*E04D 1/34* (2006.01)
*E04D 3/40* (2006.01)

(52) U.S. Cl.
CPC ..... *E04D 1/3402* (2013.01); *E04D 3/40* (2013.01)

(58) Field of Classification Search
CPC ..... E04D 1/3402; E04D 1/3414
USPC ..... 52/547, 550, 551, 715
See application file for complete search history.

(56) References Cited

U.S. PATENT DOCUMENTS 1,463,482 A * 7/1923 Mountford ..... E04D 1/34 52/547
1,493,852 A * 5/1924 Fogg ..... E04D 1/34 52/521
4,788,801 A * 12/1988 Jones ..... E04D 1/3405 52/199
5,896,719 A * 4/1999 Thornton ..... A62B 35/0068 52/698
6,474,037 B2 * 11/2002 Thompson ..... E04B 1/26 52/317
6,560,945 B1 * 5/2003 Carpenter ..... E04D 1/265 248/237
7,971,409 B2 * 7/2011 Bak ..... E04B 1/2612 29/897.34
2006/0059858 A1 * 3/2006 Layman ..... E04D 15/02 52/749.12

FOREIGN PATENT DOCUMENTS

DE 29703031 U1 * 5/1997 ..... E04D 1/3402
GB 2030629 A * 4/1980 ..... E04D 1/3402
GB 1587202 A * 4/1981 ..... E04D 1/3402
GB 2272715 A * 5/1994 ..... E04D 12/008

* cited by examiner

*Primary Examiner* — Adriana Figueroa
(74) *Attorney, Agent, or Firm* — Eric A. Hinojosa

(57) ABSTRACT

The invention describes a novel roofing trim saddle system and method of installing for use in roofing and siding applications where a roofing hip or ridge must be covered (finished). The various implementations herein describe the system as having a multitude of saddle brackets, each with a multitude of tabs that retain the roofing material (such as tiles, shingles, panels, slates, etc.). The saddle brackets attach to the roof via a fastener such as nails or screws that engage holes formed by slot tabs in the saddle bracket body. The slot tabs are used to correctly space and align the saddle bracket during installation. The system is strong, secure, adaptable, adjustable, customizable, thin, light-weight, self aligning, weather-proof, can be readily designed to accommodate many different roofing styles and materials on site, or can be manufactured to the needs of any particular roofing and siding application.

15 Claims, 8 Drawing Sheets

ROOFING TRIM SADDLE SYSTEM AND METHOD OF INSTALLING

CROSS-REFERENCE TO RELATED APPLICATIONS

This application does not claim the benefit of provisional patent application.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND

Certain roofing materials in use on modern structures require unique installation solutions due to the limitations of the roofing material. For example, if using stone slates, wood shingles, ceramic tiles, fiber reinforced cement boards, flat panels, etc. there is the issue of how to finish off the hips and ridges. A hip is essentially the outward oriented corners where roof sides intersect. A ridge, or apex, is essentially the upward oriented corner where roof sides intersect. Typically, each roof side in a hip or ridge will have a first layer of the roofing material secured to the load bearing decking of the roof. But to finish off the hip or ridge, a second layer of the roofing material is centered over the hip or ridge defining edge such that it straddles both sides. The second layer of roofing material must be secured to the load bearing decking without damaging or introducing potential leak points to the decking and first layer of the roofing material. The purpose of finishing the hip or ridge is to prevent leakage at the hip or ridge while outwardly presenting a finished look. Often a barrier layer, such as an asphalt liner, plastic liner, or metal flashing, is placed between the first and second layers of roofing material to act as a water barrier.

BRIEF SUMMARY

It is a goal of the present invention to provide a novel roofing trim saddle system and method of installing for use in roofing and siding applications. The system can be used with many different types of roofing and siding materials and installation methods.

It is another goal of the present invention to reduce the cost of installation and replacement by reducing the underlay, liner, or barrier layer preparation and simplifying the installation.

It is a goal of the present invention to overcome many of the limitations and drawbacks of the attachment means traditionally used in roofing and siding hips and ridges by providing a system that is strong, secure, adaptable, adjustable, customizable, thin, light-weight, self aligning, weather-proof, can be readily designed to accommodate many different roofing styles and materials on site, and can be manufactured to the needs of any particular roofing and siding application.

DETAILED DESCRIPTION

For ease of understanding the disclosure, the terms outward facing, outside, highest, lowest, top, bottom, etc. may be used to describe the position of any part or surface with respect to the others. For example, "outward facing" describes the side that faces towards the reader; "lowest" describes the side closest to the roof or wall decking; "bottom" means closest to the ground; and "top" means furthest from the ground.

The System:

The invention describes a novel roofing trim saddle system and method of installing for use in roofing and siding applications. The system comprises a first saddle bracket, a final saddle bracket, at least one roofing material unit, and fasteners. In some implementations, the system further comprises a barrier layer, wherein the barrier layer is comprised of a material selected from common water barrier materials such as plastic, asphalt, metal, and composites. The user will typically use one saddle bracket per each length of roofing material unit (a unit is each tile, each shingle, each slate piece, each panel, etc.). Some roofing materials are nonplanar, meaning the roofing unit is pre-formed or made with an angle such that each unit can straddle the ridge or hip. An example of this type of roofing material would be the ridge tile or hip tile having an angle. Other roofing materials are substantially flat, thus two units (joined or un-joined) will need to be used with each saddle bracket. An example of this would be slate shingles that have no angle, therefore requiring the use of two shingles. The saddle bracket will engage with the two roofing material units to form a modular section that can be repeated for the length of the target hip or ridge.

Figure 1:
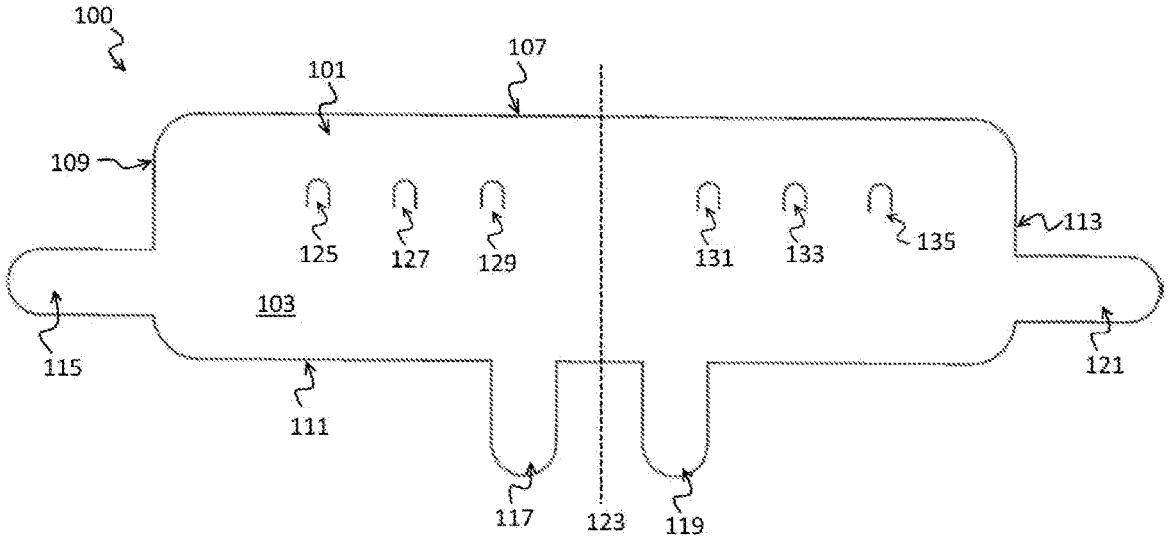
FIG. 1 depicts an orthogonal view of a top side of an implementation.

A first basic implementation of the roofing trim saddle system, saddle bracket 100, is depicted in FIG. 1. Saddle bracket 100 comprises a generally flat and thin body 101 having a substantially rectangular top side 103 and an opposing bottom side 105. The top side 103 and bottom side 105 share a side perimeter defined by four main edges: upper edge 107, left edge 109, lower edge 111, and right edge 113. Upper edge 107 is opposite lower edge 111, and left edge 109 is opposite right edge 113. Upper edge 107 and lower edge 111 are longer than left edge 109 and right edge 113. Though in other implementations other proportions may be used as the length of upper edge 107 and lower edge 111 is set to accommodate the edge width of a single nonplanar target material ridge unit (or two widths if using two separate flat units to cover the ridge as in the case of flat shingles, slates, tiles, etc.). The length of left edge 109 and right edge 113 is set to accommodate the desired overlap distance on each adjacent target material unit. The overlap distance will be discussed in greater detail below.

In the implementation shown in FIG. 1, the corners of the saddle bracket appear rounded, though upon reading the present disclosure it will be readily understood to those having ordinary skill in the art that in other possible implementations the corners could be more or less pronounced. The present implementations showing rounded corners are simply a preferred embodiment because the rounded corner is safer to handle, particularly when the material of construction may have a sharp edge, such as when a metal is used to construct the saddle bracket. Similarly, having read the present disclosure one having ordinary skill in the art would understand that while the present disclosure shows the saddle bracket having a generally rectangular body, other body shapes are possible and contemplated by this disclosure though not expressly shown in the drawings. Along with the body shape, the saddle bracket dimensions (length, width, and height or thickness) are customizable variables that can be adapted for specific roofing materials of construction (such as tiles, shingles, panels, slates, etc.). In some implementations, the saddle bracket is configured to be in the range of 2 in.-24 in. in length, and ½ in.-12 in. in width. In the configuration seen in FIG. 1, the saddle bracket length is approximately 2.85 in. and the width is approximately 4.37 in.

The saddle bracket of the present disclosure has a material of construction selected from the group including plastics, metals, composites, and resins. The characteristics of the material of construction include being readily pre-formable such as plastics, resins, and composites, or otherwise mechanically deformable (malleable), such as metals. Furthermore, the material should exhibit resistance to the effects of weather exposure, such as sun, precipitation, corrosion, temperature changes, etc. The preferred embodiment is one where the material of construction is a strong, light, and pliable metal such as stainless steel or copper. Some notable implementations use copper; others use stainless steel; others galvanized iron; others copper plated steel; and others copper plated iron. The malleability allows the saddle bracket to be applied to and accommodate the variability in roofing materials. The same property accommodates the difference in angle between the roof and the subsequent roofing unit (see FIG. 7).

The saddle bracket of the present disclosure further comprises at least four retaining tabs: left retaining tab, bottom-left retaining tab, bottom-right retaining tab, and right retaining tab. Each retaining tab is a finger-like protrusion that is connected to the body and extends away from the body. Saddle bracket 100 is comprised of left retaining tab 115 (which is positioned on left edge 109), bottom-left retaining tab 117 (which is positioned on lower edge 111), bottom-right retaining tab 119 (which is positioned on lower edge 111), and right retaining tab 121 (which is positioned on right edge 113). FIG. 1 shows the retaining tabs positioned such that a vertical line of symmetry 123 divides the saddle bracket of FIG. 1 into a left and right side. The left side of the saddle bracket 100 includes left edge 109 with left retaining tab 115 and lower edge 111 with bottom-left retaining tab 117. The right side of saddle bracket 100 includes lower edge 111 with bottom-right retaining tab 119 and right edge 113 with right retaining tab 121. Upon reading the present disclosure it will be readily understood to those having ordinary skill in the art that in other possible implementations the retaining tab positions need not be symmetrical so long as at least one retaining tab appears on each of left edge 109 and right edge 113, and at least one retaining tab appears on each half of lower edge 111. The symmetrical appearance of the retaining tabs of FIG. 1 is a preferred embodiment that simplifies the manufacturing and use of the saddle bracket in the present system. Furthermore, it will be understood by one having ordinary skill in the art upon reading the present disclosure that the retaining tab length and width dimensions are customizable variables that can be adapted for specific roofing materials of construction (such as tiles, shingles, panels, slates, etc.). In some implementations, each retaining tab is configured to be in the range of ⅛ in.-12 in. in length, and 1/16 in.-3 in. in width. In the configuration seen in FIG. 1, each retaining tab length is approximately 1.69 in. and the width of each is approximately 0.75 in.

Figure 2:
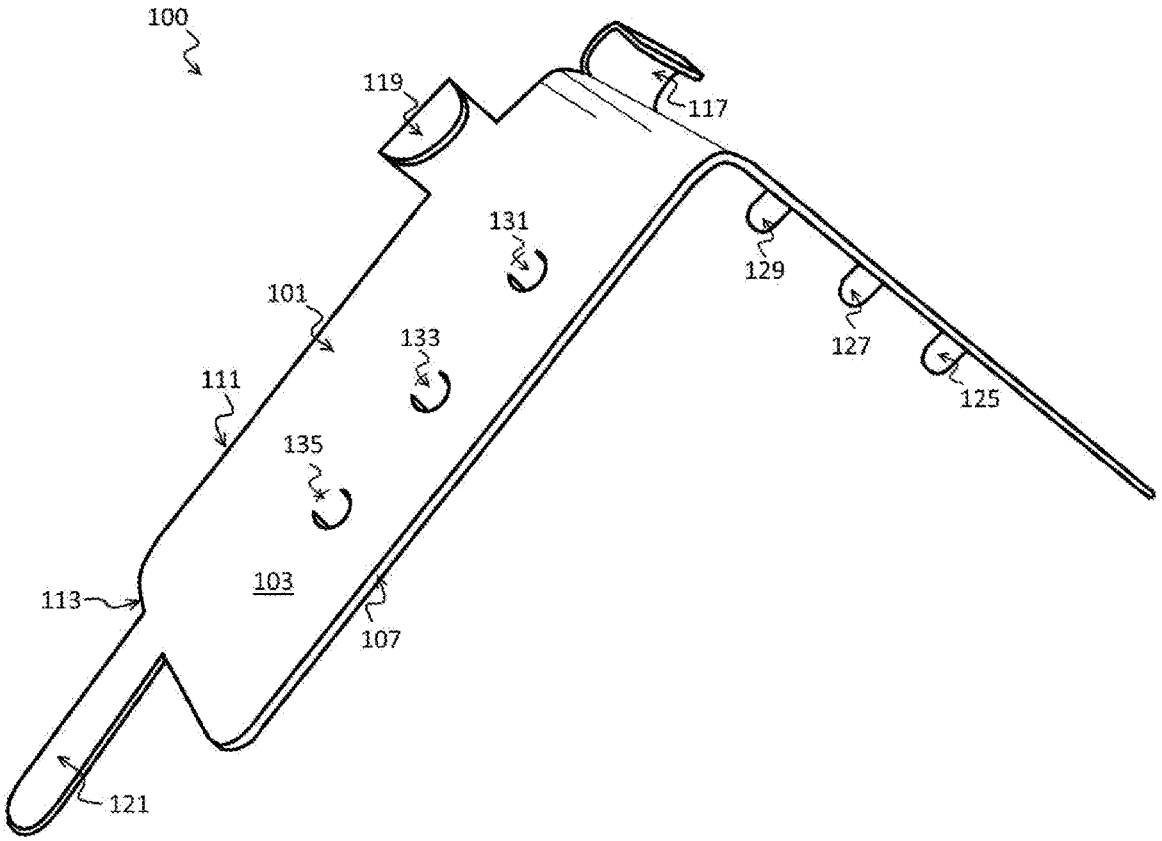
FIG. 2 depicts a perspective view of an implementation wherein the saddle bracket is bent, the tabs on lower edge 111 are bent, the tabs on left edge 109 and right edge 113 are not bent, and the slot tabs are in the prepared position.

The retaining tabs shown in FIG. 1 are flat (laying in the same plane as the saddle bracket body 101). In this implementation, the retaining tabs can be bent upward and around a roofing material (such as tiles, shingles, panels, slates, etc.) during installation (use). The retaining tab could be bent twice at 90° angles, such as seen in FIG. 2. Though any combination of curves and bends resulting in a 180° angle where the distal end of the retaining tab returns towards the saddle bracket can be used in the various implementations. For example, in one implementation, the retaining tab hooks back towards the body. The preferred implementation of the retaining tab is coplanar with the body but can be bent by the user during installation to allow the saddle bracket to accommodate a wide range of roofing material shapes and thicknesses. Furthermore, it allows for the use of non-uniform roofing materials without needing a different saddle bracket to accommodate individual units of the roofing material. Consider slates, which may have a certain intrinsic variability in the dimensions of each unit among the batch being used for the roofing. However, it will be understood by one having ordinary skill in the art upon reading the present disclosure that other implementations have a retaining tab that is pre-bent or preformed into the desired orientation. The pre-bent or preformed retaining tabs have been adapted to fit roofing materials having dimensions within a pre-set range.

Figure 8:
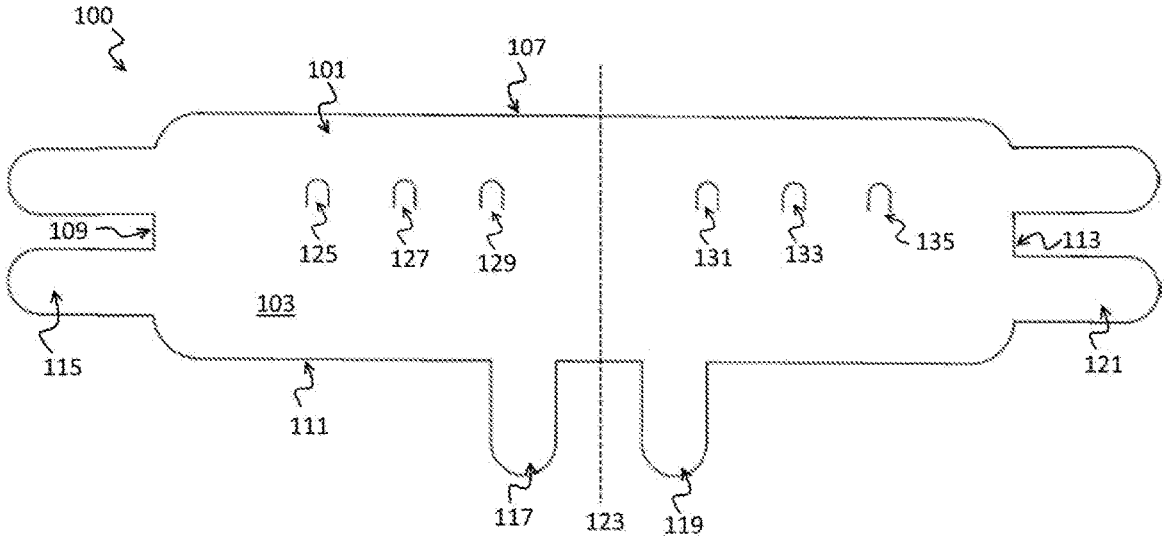
FIG. 8 depicts a perspective view of an implementation similar to FIG. 1 but with two tabs on the right edge and left edge.
Figure 9:
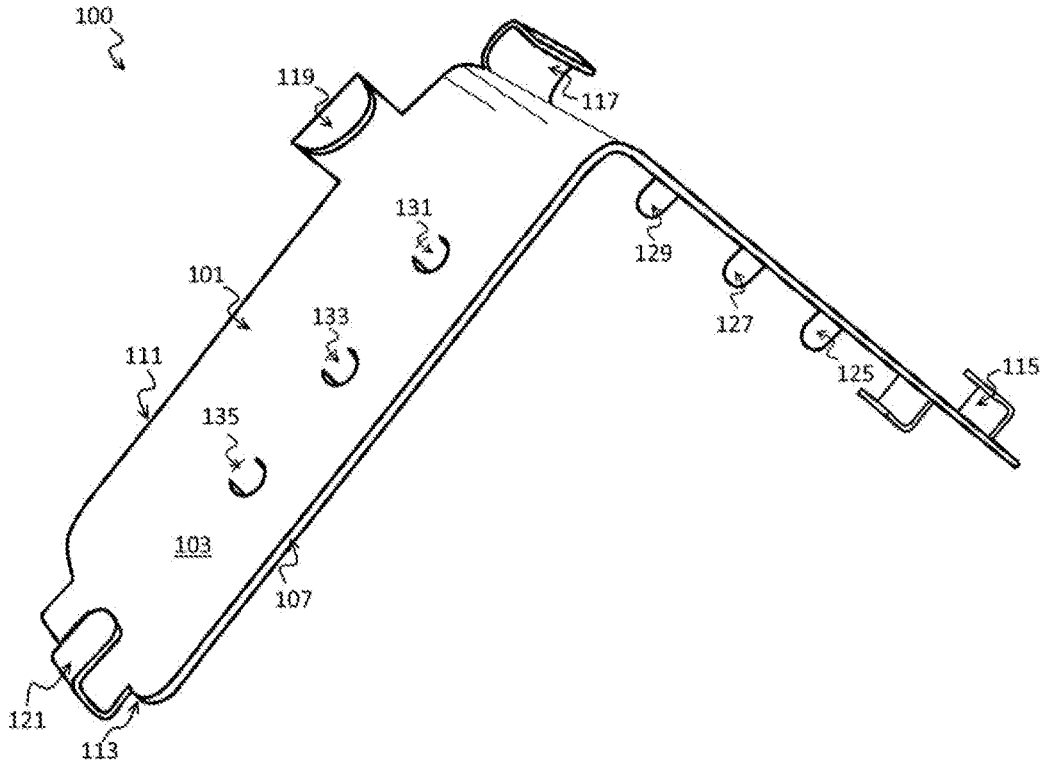
FIG. 9 depicts a perspective view of an implementation similar to FIG. 8 but with one of the two tabs on the right edge and left edge bent in the opposite direction (downward).
Figure 10:
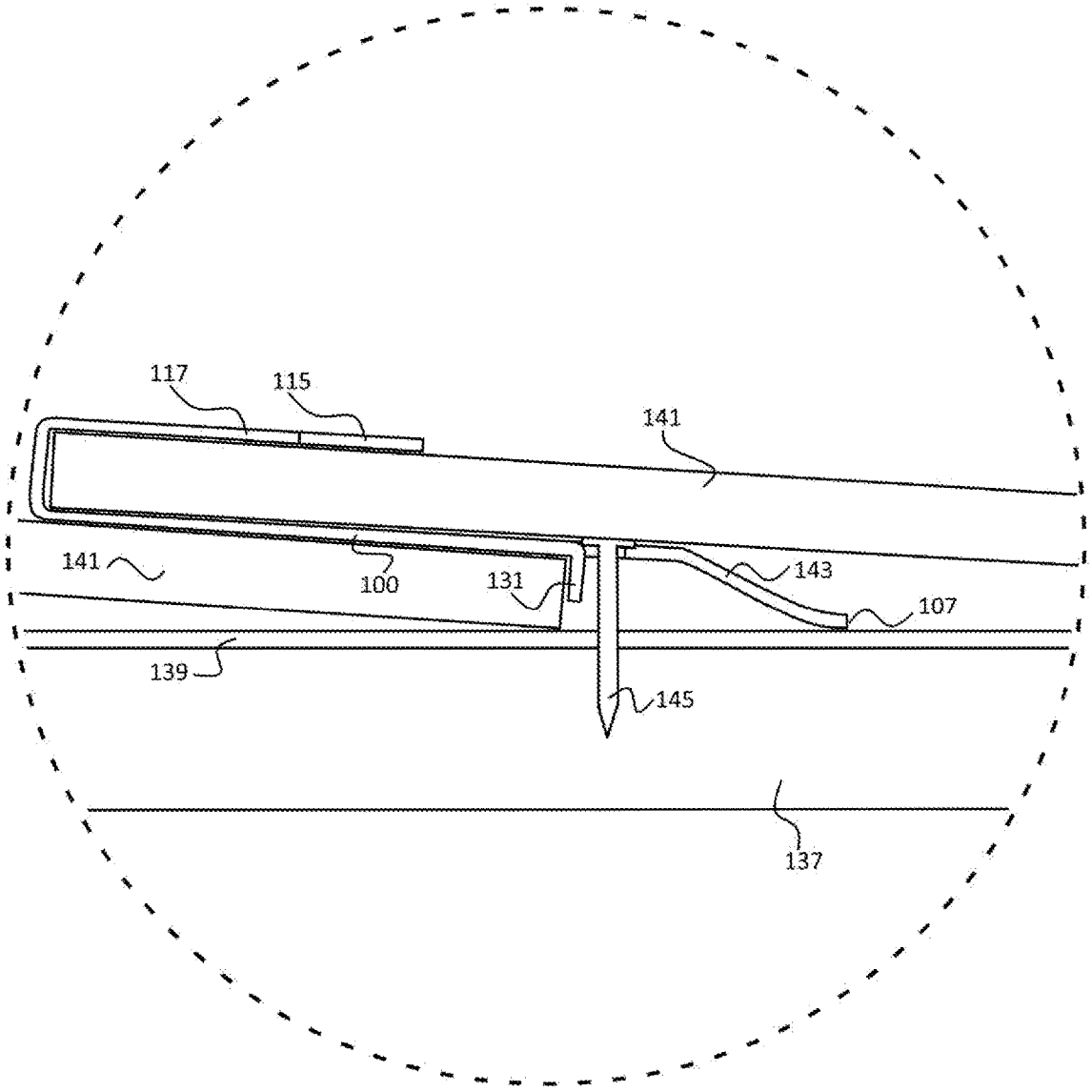
FIG. 10 depicts an enlarged portion of FIG. 7.

In other implementations, the saddle bracket has at least two retaining tabs on each of left edge and right edge of the body. In some implementations having two retaining tabs on each of left edge and right edge of the saddle bracket body, one of the two retaining tabs of left edge and one of the two retaining tabs of right edge are bent upward as described in the preceding paragraph to engage with the roofing material unit of that modular section—but the second retaining tab of left edge and the second retaining tab of right edge are bent downward and around to engage with the roofing material unit of the preceding modular section. See FIG. 8 and FIG. 9. Thus the roofing units are further engaged with the saddle brackets and the modular sections are further linked.

The saddle bracket of the present disclosure further comprises at least one slot tab on each side of the line of symmetry. In other words, a basic implementation of the present disclosure will comprise at least a first slot tab in the left side of the body and at least a second slot tab in the right side of the body, such that the line intersecting those slot tabs is parallel to the lower edge of the body. This will help align each subsequent row of roofing material. Each slot tab is formed by a small slit in the saddle bracket body. The slit shape defines the slot tab shape. For example, a slit shaped like a "V" results in a pointed slot tab, while a slit shaped like a "U" takes on a rounded tab shape. In some implementations, such as seen in FIG. 1, a "U" shape is used for the slits, resulting in "U" shaped slot tabs. In some implementations, the slit may be formed into the saddle bracket body during casting, if the saddle bracket is formed by casting. In other implementations the slit may be cut, stamped, carved, or burned out of the saddle bracket body. Returning to FIG. 1, saddle bracket 100 has six slot tabs: slot tab 125, slot tab 127, slot tab 129, slot tab 131, slot tab 133, and slot tab 135. The slot tabs of FIG. 1 are positioned such that all six slot tabs are aligned at intervals along a line that perpendicularly intersects the line of symmetry 123, such that slot tab 125, slot tab 127, and slot tab 129 appear on the left side of the saddle bracket and slot tab 131, slot tab 133, and slot tab 135 appear on the right side of the saddle bracket.

Each slot tab has a first position (or state) "unprepared," a second position "prepared," and a third position "flattened." The unprepared position is where the slot tabs are still in the plane defining the saddle bracket body. The prepared position is where the slot tabs are perpendicular to the saddle bracket body, extending down ward and away from bottom side of the body. See FIG. 2. The flattened position is where the slot tabs have been flattened against the bottom side of the saddle bracket body. In the prepared and flattened positions, a hole in the bracket body is created at each slot tab. This hole will be used for attachment means (a fastener such as nails, screws, or staples) during installation of the saddle bracket. Furthermore, the prepared slot tab will act as an alignment shoulder to position against the top-most end of the preceding roofing unit (tile, shingle, slate, panel, etc.). Preferred means of attachment include selecting a fastener such as galvanized nails or decking screws that pass through the holes created by each slot tab in a prepared or flattened position. Each fastener partially passes through one of the slot tab holes and then penetrates the underlay layer (if present) thereby engaging the target roof decking and possibly the rafters supporting the decking. However, in some implementations the saddle bracket comprises holes without the slot tab for the engagement of the fasteners that pass through the hole and into the target roof decking.

Figure 7:
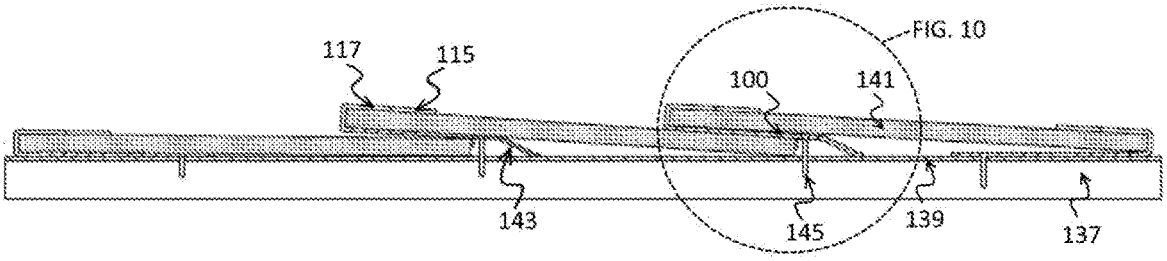
FIG. 7 depicts a cross sectional view of the roofing trim saddle system as applied to a target surface to show the overlap of the saddle bracket with the adjacent roofing material unit.

Returning to the cross-sectional view of FIG. 7, a fastener 145 holds each saddle bracket 100 to the target roof 137. Each roofing material unit 141 is held by the engaged retaining tabs (115 and 117) of saddle bracket 100. Notice the lip 143 that forms in the saddle bracket 100 to accommodate the difference in angle between the section of the body 101 pressed flat against the underlay layer 139 and the roofing material unit over which the saddle bracket 100 is installed. In some implementations, the lip 143 is preformed into the saddle bracket to a height that accommodates the thickness of a specific roofing material unit. In other implementations, the lip is formed during installation of the saddle bracket, where the saddle bracket is constructed of a readily deformable material such as a malleable thin metal.

Note that for roofing materials that are substantially flat, two units are required to form the angle of the ridge or hip. These two units may be joined or un-joined. In other words, the two units of roofing material may be connected via some material or adhesive, or not. In some implementations, the roofing material units may be joined via a durable and flexible material that acts as a hinge.

In some implementations, a long base member or strip is used to attach multiple saddle brackets at pre-measured intervals. This strip can be used to increase the speed of installation.

The Method of Installation:

For installation (use) of the roofing trim saddle system, the target roofing surface must be prepared. Each side of the target roof should have the roofing material installed. A barrier layer should be positioned over the target ridge or hip of the target roof with appropriate overhang on either side of the ridge or hip defining edge, if the barrier layer is needed or desired. Note that the barrier layer will be held in place by the saddle system of the present disclosure upon installation, therefore no additional attachment means are needed for the barrier layer beyond what is necessary to initially position it over the target ridge or hip edge.

In some implementations the body of the saddle bracket is pre-folded along the line of symmetry to a pre-determined angle corresponding to the ridge or hip angle of the target roof. However, in other implementations, such as saddle bracket 100 (seen in FIG. 1), the body is not pre-folded. Instead, during installation each saddle bracket is folded along the line of symmetry 123 to match the angle of the target ridge or hip (taking the existing roofing into account).

Similarly, in some implementations the slot tabs are pre-folded downward, while in others the slot tabs are not. Returning to saddle bracket 100, the slot tabs that will be used can be folded at the time of installation by pushing each from the top side 103 inward towards the bottom side 105 until the slot tab is perpendicular to the saddle bracket body 101 (slot tab prepared position).

Likewise, in some implementations the retaining tabs are pre-folded into the retaining structure, while in others the retaining tabs are not pre-folded. Returning to saddle bracket 100, the retaining tabs can be prepared at the time of installation, by bending them up and around the roofing material unit that will be used. Therefore, the distance between the first and second bend on each retaining tab should be equal to or slightly greater than the thickness of the target roofing material unit.

Figure 3:
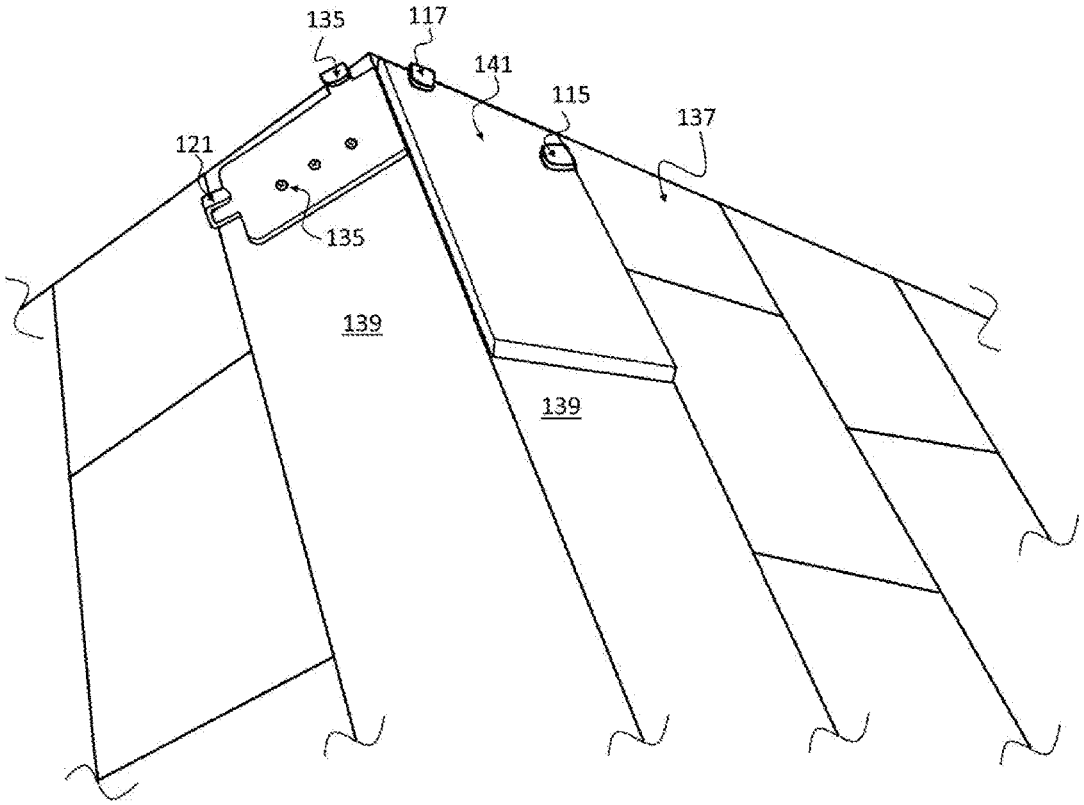
FIG. 3 depicts a partial perspective view of the partial installation of an implementation.
Figure 4:
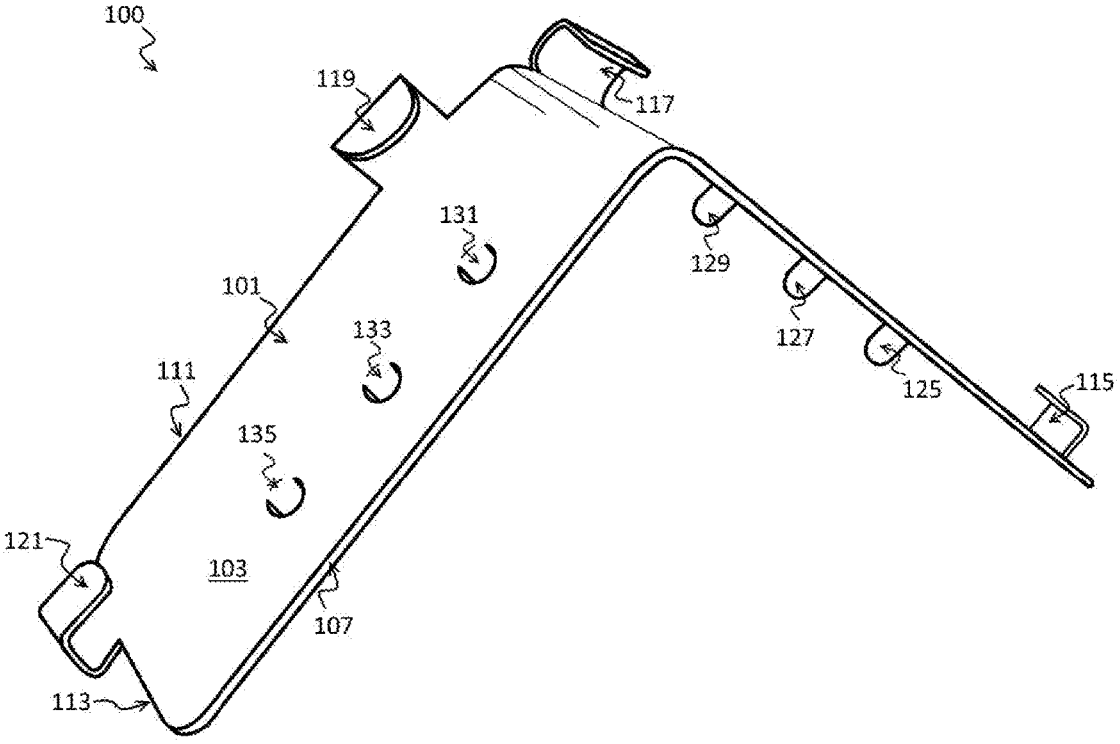
FIG. 4 depicts a perspective view of an implementation wherein the saddle bracket is bent, the tabs on lower edge 111 and right edge 113 are bent, the tabs on left edge 109 are bent, and the slot tabs are in the prepared position.
Figure 5:
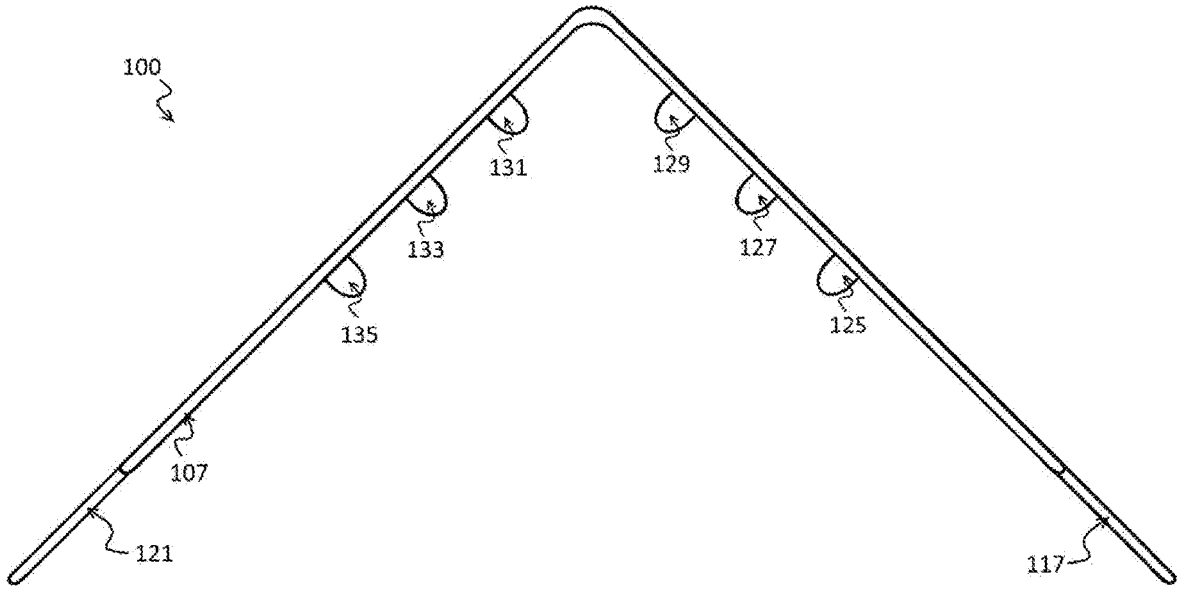
FIG. 5 depicts a side view of an implementation wherein the saddle bracket is bent and the slot tabs are in the prepared position.
Figure 6:
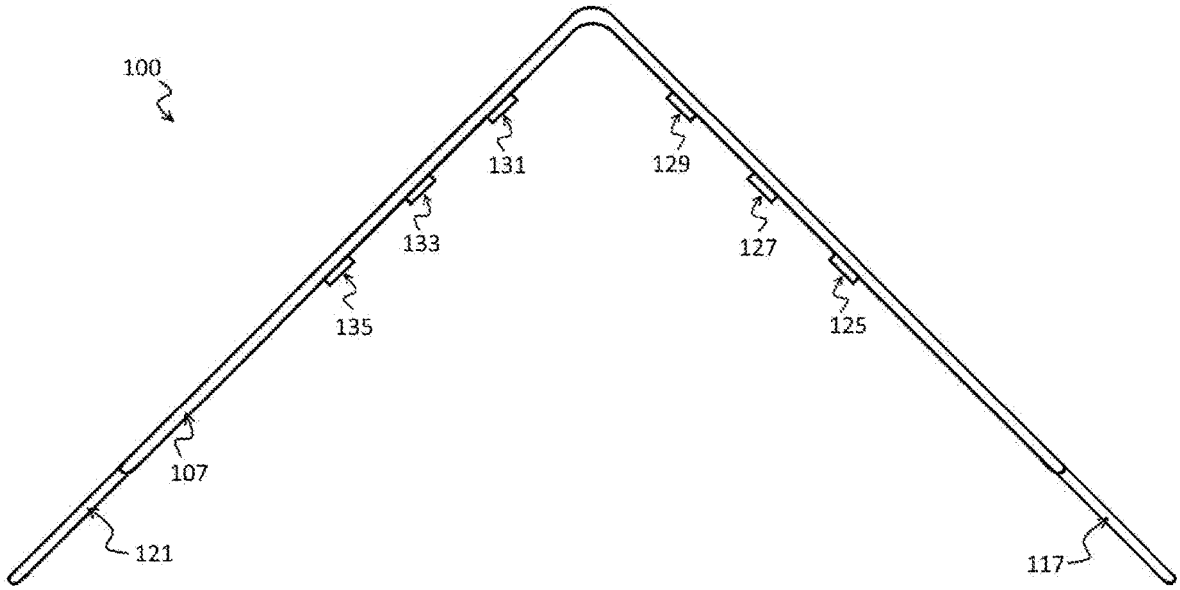
FIG. 6 depicts a side view of an implementation wherein the saddle bracket is bent and the slot tabs are in the flattened position.

The installation or use of the roofing trim saddle system is comprised of modular sections. For reference, see FIG. 3, which shows a portion of a target roof with an underlay layer spread over the ridge of the roof, a first saddle bracket installed with fasteners at the edge of the target roof, and a first roofing material unit installed on one side of the first saddle bracket—a first modular section. To begin the installation of a first modular section, the bottom of the target hip or an end of the target ridge must be identified. This will be called the starting edge point. A first saddle bracket can be positioned at the starting edge point over the ridge or hip such that the bottom side is adjacent to the barrier, and the lower edge is oriented towards the starting edge point of the target hip or ridge. The slot tabs of the first saddle bracket should not be in the prepared position, but rather in the flattened position. A means of attachment (a fastener such as a screw or nail) is applied through at least one of the open holes created at each slot tab on the left side of the first saddle bracket, and a means of attachment is applied through at least one of the open holes created at the slot tab on the right side of the first saddle bracket. In a preferred implementation at least two screws are used on each side of the line of symmetry of the saddle bracket, but the position of each screw is determined by the placement of the slot tabs and the requirements of the target roof (such as whether the ridge is vented or not). A first single unit of the roofing material (or two units if the units are substantially flat and therefore one is required for each side of the hip or ridge) is positioned over the top side of the first saddle bracket body such that the end of the roofing material closest to the starting edge engages with the retaining tabs of lower edge. The retaining tab(s) of the left edge of the first saddle bracket should engage with the left-most side edge of the first roofing material unit and the retaining tab(s) of the right edge of the first saddle bracket should engage the right-most side edge of the first roofing material unit. If the retaining tabs were pre-formed or pre-bent, then the first roofing material unit will simply slip into the retaining tabs. If the retaining tabs were not pre-formed or pre-bent, then the retaining tabs will then be bent around the first roofing unit. This completes the first modular section.

Once the first modular section has been installed, additional modular sections may be needed to completely cover the length of the target hip or ridge. Assuming that another modular section is needed, the second saddle bracket must have the slot tabs in the prepared position. The second saddle bracket is oriented similarly to the first saddle bracket—straddling the target hip or ridge and with the lower edge closest to the starting edge point. However, the second saddle bracket is positioned partially over the top most edge of the first roofing material unit of the first modular section, such that the prepared slot tabs of the second saddle bracket rest adjacent to that top most edge of the first roofing material unit. Means of attachment should be applied to the second saddle bracket as before with the first saddle bracket. A second roofing unit (or two, as needed) should be engaged by the left edge and right edge retaining tabs of the second saddle bracket as before with the first saddle bracket. This completes the second modular section.

The process can be repeated as necessary to install additional modular sections until the point where only one more modular section will fully cover the end of the target hip or ridge (including appropriate overhang if any). The final modular section will require two saddle brackets, referred to as the "second to last saddle bracket" and the "final saddle bracket." The second to last saddle bracket is installed the same as with the previous modular section. However, before the final roofing material unit (or two) is engaged by the retaining tabs, the final saddle bracket must be installed. The final saddle bracket must have the slot tabs in the flattened position. The orientation of the final saddle bracket is reversed compared to all the others before it. Thus, the lower edge of the final saddle bracket will be oriented towards the end of the target hip or ridge. The final saddle bracket must be positioned such that the retaining tabs of lower edge will engage the top most edge of the final roofing material unit (or two) at the end of the target hip or ridge (including appropriate overhang if any). The means of attachment are applied to the final saddle bracket as with the other saddle brackets. The final roofing material unit (or two) is then engaged by the retaining tabs of the second to last and final saddle brackets. This completes the final modular section.

Any excess underlay layer (also known as a barrier layer) can be trimmed or removed to complete the installation.

The installation method is similar for the implementations having holes in place of the slot tabs, though the step preparing the position of the slot tab is unnecessary.

For installation of certain implementations, such as those described earlier wherein the saddle bracket has retaining two tabs on each of left edge and right edge, the process is largely the same. However, in the implementations wherein there are two retaining tabs on each of left edge and right edge of the saddle bracket, one retaining tab on each edge is for engaging the roofing material unit of the previous modular section. This is accomplished by bending the retaining tab downward and around the roofing material unit of the previous modular section. The remaining retaining tab on the left edge and right edge of the saddle bracket body is folded upward and around the roofing material unit that is being installed with the present module. This step of the installation can be done concurrent with the engagement of the roofing material unit of the modular unit that is being installed, or optionally, it can be done prior to the application of the means of attachment.

Although the implementations have been described and illustrated with a certain degree of detail or with reference to one or more particular embodiments, it is understood that the present disclosure has been made only by way of example. It should be understood that the invention is not intended to be limited to the particular forms disclosed. Furthermore, the invention is amenable to various modifications and alternative forms. Obvious variations and other various changes in the composition, combination, and arrangement of parts can be utilized to by those skilled in the art without departing from the spirit and scope of the invention, as herein disclosed and claimed.

The invention claimed is:

1. A roofing trim saddle system for covering a target roofing hip or ridge comprising:

a multitude of saddle brackets, comprising at least a first saddle bracket and a final saddle bracket, wherein each saddle bracket of the multitude of saddle brackets is configured to straddle a target roof hip or ridge, and wherein each saddle bracket of the multitude of saddle brackets comprises a body that is generally flat, thin, and rectangular, comprising a top side, a bottom side, an upper edge, a left edge, a lower edge, and a right edge, and wherein the upper edge and the lower edge of the body are the lengths and the left edge and the right edge of the body are the widths of the body, and further wherein the body has a left side partially formed by the left edge and a right side partially formed by the right edge, and further wherein the body comprises a multitude of retaining tabs, which are finger-like protrusions extending from the body, positioned such that there is at least one retaining tab on the left edge, at least two retaining tabs on the lower edge, and at least one retaining tab on the right edge, and further wherein the body comprises a multitude of slot tabs, which are tabs formed into the body, positioned on the body such that there is at least a first slot tab positioned on the left side of the body and at least a second slot tab positioned on the right side of the body, such that the line intersecting the first slot tab and the second slot tab is parallel to the lower edge of the body;

a multitude of roofing material units numbering one fewer than saddle brackets; and fasteners that attach each saddle bracket of the multitude of saddle brackets to the target roof hip or ridge by engaging with the multitude of slot tabs of each saddle bracket of the multitude of saddle brackets and the target roof hip or ridge;

wherein the multitude of slot tabs are configured to engage the top edge of the preceding roofing material unit.

2. The roofing trim saddle system of claim 1 further comprising an underlay layer that is impermeable to water, positioned between each saddle bracket of the multitude of saddle brackets and the target roof hip or ridge.

3. The roofing trim saddle system of claim 1 wherein each saddle bracket of the multitude of saddle brackets, comprises:

at least two retaining tabs on the left edge of the body and at least two retaining tabs on the right edge of the body.

4. The roofing trim saddle system of claim 2 wherein each saddle bracket of the multitude of saddle brackets comprises:

at least six slot tabs such that three are positioned on the left side of the body and three are positioned on the right side of the body.

5. The roofing trim saddle system of claim 1 wherein each slot tab of the multitude of slot tabs in each saddle bracket of the multitude of saddle brackets is formed by a U-shaped slit in the body of each saddle bracket of the multitude of saddle brackets.

6. The roofing trim saddle system of claim 1 wherein each saddle bracket of the multitude of saddle brackets is planar but foldable along a center line separates the left side of the body from the right side of the body.

7. The roofing trim saddle system of claim 1 wherein each saddle bracket of the multitude of saddle brackets is angled along a center line that separates the left side of the body from the right side of the body.

8. The roofing trim saddle system of claim 1 wherein each retaining tab of the multitude of retaining tabs in each saddle bracket of the multitude of saddle brackets is coplanar to the body of each saddle bracket of the multitude of saddle brackets but is foldable.

9. The roofing trim saddle system of claim 1 wherein each retaining tab of the multitude of retaining tabs in each saddle bracket of the multitude of saddle brackets is pre-formed into a hook shape that bends up and back toward the body of each saddle bracket of the multitude of saddle brackets.

10. The roofing trim saddle system of claim 1 wherein each unit of the multitude of roofing material units is nonplanar and pre-formed with an angle allowing the unit to straddle the target roof ridge or hip.

11. The roofing trim saddle system of claim 1 wherein each unit of the multitude of roofing material units is planar, and wherein two roofing material units are engaged by each saddle bracket of the multitude of saddle brackets such that a first roofing material unit is engaged by the left side of the body of the saddle bracket and a second roofing material unit is engaged by the right side of the body of the saddle bracket.

12. The roofing trim saddle system of claim 1 wherein each saddle bracket of the multitude of saddle brackets is constructed of a material having one or more of the following qualities: weather resistant, durable, stiff, strong, and malleable.

13. The roofing trim saddle system of claim 1 wherein the fastener is selected from one of the following: nails, screws, construction adhesive, rivets, staples, or bolts.

14. The roofing trim saddle system of claim 1 wherein each saddle bracket of the multitude of saddle brackets is further comprising a lip formed in the body and located in between the multitude of slot tabs and the upper edge.

15. A method of installation of a roofing trim saddle system comprising the steps:

preparing a target roof hip or ridge, which includes positioning an underlay barrier layer over the target roof hip or ridge;

taking a first saddle bracket having slot tabs and flattening the slot tabs open;

identifying a starting edge of the target hip or ridge by selecting either end if working on a ridge or selecting the end that is lowest if working on a hip;

bending a first saddle bracket body along a center line that separates a left side of the body from a right side of the body of the saddle bracket to accommodate the hip or ridge angle;

positioning the first saddle bracket on the starting edge of the target roof hip or ridge such that the first saddle bracket straddles the hip or ridge evenly;

orienting the first saddle bracket, having a lower edge with retaining tabs, such that the lower edge is along the starting edge of the target roof hip or ridge;

attaching the first saddle bracket to the target roof hip or ridge using a multitude of fasteners such that a fastener engages each of the open slot tabs;

placing one or more roofing units on the first saddle bracket;

engaging the one or more roofing units with the retaining tabs of the first saddle bracket;

taking a second saddle bracket having retaining tabs and slot tabs and opening the slot tabs so that they are perpendicular to the saddle bracket body;

positioning the second saddle bracket such that the slot tabs engage the top edge of the previously installed roofing unit that was distal to the first saddle bracket, and such that the second saddle bracket is partially over the previously installed roofing unit;

attaching the second saddle bracket to the target roof hip or ridge with a multitude of fasteners such that each engages one of the open slot tabs;

placing one or more roofing units on the second saddle bracket;

engaging the one or more roofing units with the retaining tabs of the second saddle bracket;

repeating the process to add additional saddle brackets and roofing units as needed until only one more is needed to finish the target roof hip or ridge;

identifying an end point of the hip or ridge;

positioning and attaching a second to last saddle bracket according to the previous alignment and positioning steps;

positioning a final saddle bracket at the end point of the target roof hip or ridge, but with an orientation opposite that of the previous saddle brackets, such that the lower edge of the saddle bracket is aligned with the end point of the target roof hip or ridge;

attaching the final saddle bracket to the target roof hip or ridge with fasteners that engage the slot tabs;

placing one or more roofing units on the second to last saddle bracket and final saddle bracket such that the retaining tabs of both brackets engage the one or more roofing units; and trimming excess underlay barrier layer, if any.

* * * * *